US007934848B1

(12) United States Patent
Pever et al.

(10) Patent No.: US 7,934,848 B1
(45) Date of Patent: May 3, 2011

(54) STAIR RISER LIGHT AND METHOD FOR INSTALLING SAME

(75) Inventors: Steve E. Pever, Bellefontaine, OH (US); Timothy C. Rothwell, Dublin, OH (US)

(73) Assignee: The Crane Group Companies Limited, Columbus, OH (US)

( * ) Notice: Subject to any disclaimer, the term of this patent is extended or adjusted under 35 U.S.C. 154(b) by 60 days.

(21) Appl. No.: 12/049,979

(22) Filed: Mar. 17, 2008

(51) Int. Cl.
*F21S 8/00* (2006.01)
*F21V 3/00* (2006.01)
*F21V 15/00* (2006.01)

(52) U.S. Cl. ..... 362/146; 362/311.14; 362/364

(58) Field of Classification Search ..... 362/146, 362/576, 147, 364, 354, 327, 328, 330, 307, 362/308, 309, 300, 501, 26, 28, 29, 30, 602, 362/605, 329, 311.01, 311.14
See application file for complete search history.

(56) References Cited

U.S. PATENT DOCUMENTS 2,657,367 A 10/1953 Brooks
2,721,255 A 10/1955 Lanmon
2,742,549 A 4/1956 Peters
2,910,576 A * 10/1959 Meese ..... 362/273
3,137,938 A * 6/1964 Artil Arrighini ..... 29/558
3,448,257 A 6/1969 Sackett, Jr.
4,080,034 A 3/1978 Werner
4,270,830 A 6/1981 Brenner
4,425,601 A * 1/1984 Donahue ..... 362/146
4,648,675 A 3/1987 Gaines
4,888,669 A 12/1989 Hanson
4,951,184 A 8/1990 Makurof
5,001,611 A 3/1991 Beachy et al.
5,007,855 A 4/1991 O'Brien et al.
5,057,979 A 10/1991 Carson et al.
5,429,530 A 7/1995 Zander et al.
5,493,825 A 2/1996 Gaston
5,642,934 A 7/1997 Haddad
5,658,071 A 8/1997 Kelpin
5,701,236 A 12/1997 Viviano
6,004,154 A 12/1999 O'Brien
6,425,676 B1 7/2002 Lyons
6,467,928 B2 10/2002 Crelin
6,585,398 B1 7/2003 Haddad
6,742,748 B1 6/2004 Gretz
6,779,907 B2 * 8/2004 Beadle ..... 362/145
6,808,283 B2 * 10/2004 Tsao ..... 362/95
6,941,715 B2 9/2005 Potter
7,021,786 B1 4/2006 Sandor, Sr.

(Continued)

OTHER PUBLICATIONS

Fink, Justin, "Accent Lighting for Your Deck," Fine Homebuilding, Aug./Sep. 2007, Taunton Press, Inc. pp. 60-65.*

(Continued)

*Primary Examiner* — Jong-Suk (James) Lee
*Assistant Examiner* — David R Crowe
(74) *Attorney, Agent, or Firm* — Standley Law Group LLP

(57) ABSTRACT

A lighting system for illuminating stairs and a method for installing the same. The wiring for the lighting system may be hidden from view, providing a more aesthetically pleasing appearance. Furthermore, the lighting system may be installed simultaneously with the deck itself, or afterwards. Embodiments of the present invention include stair riser lights which extend only minimally from the front surface of the stair riser. Embodiments of the present invention may focus the light towards the horizontal surface in front of the stair riser. Embodiments of the present invention may also protect the lighting system from environmental damage. Embodiments of the installation method include utilizing a jig so that the light assembly may be quickly and accurately installed.

19 Claims, 3 Drawing Sheets

U.S. PATENT DOCUMENTS

| | | | | |
|---|---|---|---|---|
| 7,036,960 | B1 | 5/2006 | Gretz | |
| 2002/0172042 | A1 * | 11/2002 | Wen-Chung | 362/276 |
| 2002/0191391 | A1 | 12/2002 | Van Etten | |
| 2004/0095772 | A1 | 5/2004 | Hoover et al. | |
| 2005/0128758 | A1 | 6/2005 | Brick | |
| 2009/0175030 | A1 * | 7/2009 | Sears | 362/146 |

OTHER PUBLICATIONS

Focus Industries, "Step Lights SL-08-Series" available at http://www.focusindustries.com/pdf/SL-08_Cut_Sheet.pdf [accessed Sep. 4, 2009].*

Focus Industries, "Focus landscape lighting," Jan. 12, 2006, available at: http://web.archive.org/web/20060112004854/http://www.focusindustries.com/products-sl.html [accessed Sep. 4, 2009].*

DecksDirect.com, "Highpoint Estes—Rail Light" [available at http://www.decksdirect.com/highpoint-estes-rail-light-4.html] accessed Feb. 23, 2010.*

Elights.com, Progress P8651 Quick Connector Landscape Accessory, printed May 8, 2008, 1 page, http://www.elights.com/p8651.html.

Elights.com, Kichler 15509 Quick Disk Low Voltage Cable Connector, printed May 8, 2008, 1 page, http://www.elights.com/quiccon.html.

Hadco, Connector (LVC3), printed May 8, 2008, 1 page, http://www.hadco.com/hadco/Public/ProductDetail.aspx?pid=1149&Id=16.

Hadco, Connector (LVC4), printed May 8, 2008, 1 page, http://www.hadco.com/hadco/Public/ProductDetail.aspx?pid=1150&Id=16.

* cited by examiner

STAIR RISER LIGHT AND METHOD FOR INSTALLING SAME

BACKGROUND AND SUMMARY OF THE INVENTION

Embodiments of the present invention relate generally to lighting systems for outdoor deck areas, for lighting purposes as well as decorative purposes, and more particularly to several embodiments of a stair riser light and a method for installing a stair riser light.

Outdoor deck areas are very popular as they add to the beauty of the home as well as provide a functional place to enjoy the outdoors. However, many decks do not have a sufficient lighting such that they can be enjoyed during the night time as well as the day time. Furthermore, the decks that currently employ lighting systems must run the wiring on the surface of the posts, railings, and deck surface, providing a look that is not aesthetically pleasing. Occasionally the wires are hidden by a conduit, but these materials are still not aesthetically pleasing. Also, current lighting systems mount on to the surface of deck materials and thus subject the deck users to various hazards such as catching their feet or clothing on the light assemblies.

Exemplary embodiments of the present invention provide a lighting system for an outdoor deck area that provides sufficient lighting while at the same time adding to the aesthetic value of the area. Therefore, embodiments of the present invention may substantially hide the wires from view and incorporate the light housings into the deck materials.

Embodiments of the present invention provide a lighting system that may be built specifically for the deck including the deck surface, railings, and posts to provide a total deck experience. Also, the deck may not need to be torn up and rearranged to put in the lighting system. The deck may be manufactured to allow the easy installation of the lighting system.

The lighting system does not have to be tailor-made for every home, but can be manufactured at a high production rate and can be installed at existing homes or businesses. Also, the embodiments do not need to be installed by a specialized carpenter, but instead can be installed by the homeowner. In this way, cost is minimized.

Embodiments of the present invention may protect the lighting assembly from environmental damage, including but not limited to water damage and insect damage.

Embodiments of the present invention include stair riser lights which are mounted within the vertical face of the stair riser such that the light assembly extends only minimally from the stair riser surface, providing a look that is both aesthetically pleasing and safe for the deck users. Furthermore, embodiments of the present invention may focus the light so that, rather than shining in all directions, the light is directed to illuminate the stair surface beneath the riser.

In addition to the novel features and advantages mentioned above, other benefits will be readily apparent from the following descriptions of the drawings and exemplary embodiments.

DETAILED DESCRIPTION OF EXEMPLARY EMBODIMENT(S)

Exemplary embodiments of the present invention are directed to the figures described herein.

Figure 1A:
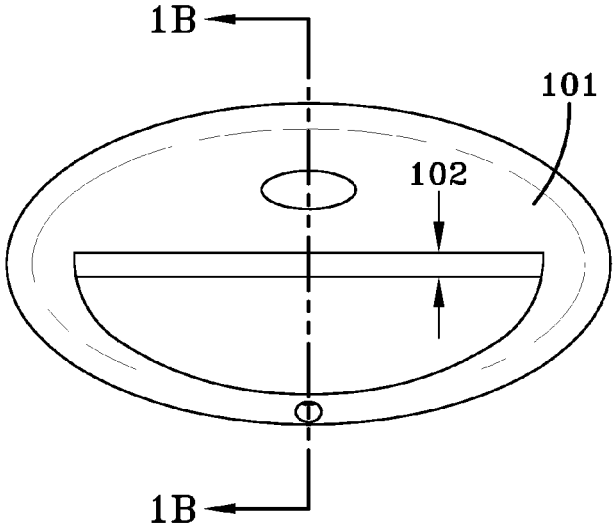
FIG. 1A is front view of a front plate.

FIG. 1A is front view of an exemplary embodiment of a front plate 101. A horizontal void 102 runs down the center of the front plate 101. Cross-section 1B runs vertically down the center of the front plate 101 and through the horizontal void 102.

Figure 1B:
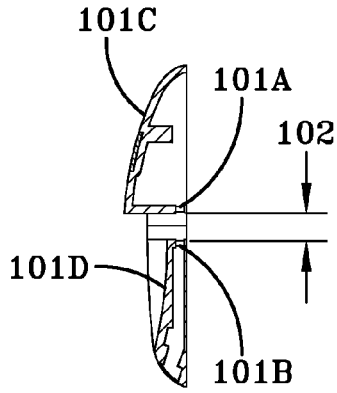
FIG. 1B is a cross-sectional view of a front plate.

FIG. 1B is a cross-sectional view of a front plate or cover 101. The horizontal void 102 is shown as the un-shaded area in the center of the cross-section 1B. The front cover 101 has an upper portion 101A and a lower portion 101B that define the void 102. Also, in this example, a convex portion 101C of front cover 101 extends up from upper portion 101A, and a concave portion 101D of front cover 101 extends down from lower portion 101B. In one embodiment, a front cover 101 may be opaque and comprised of metal or plastic.

Figure 1C:
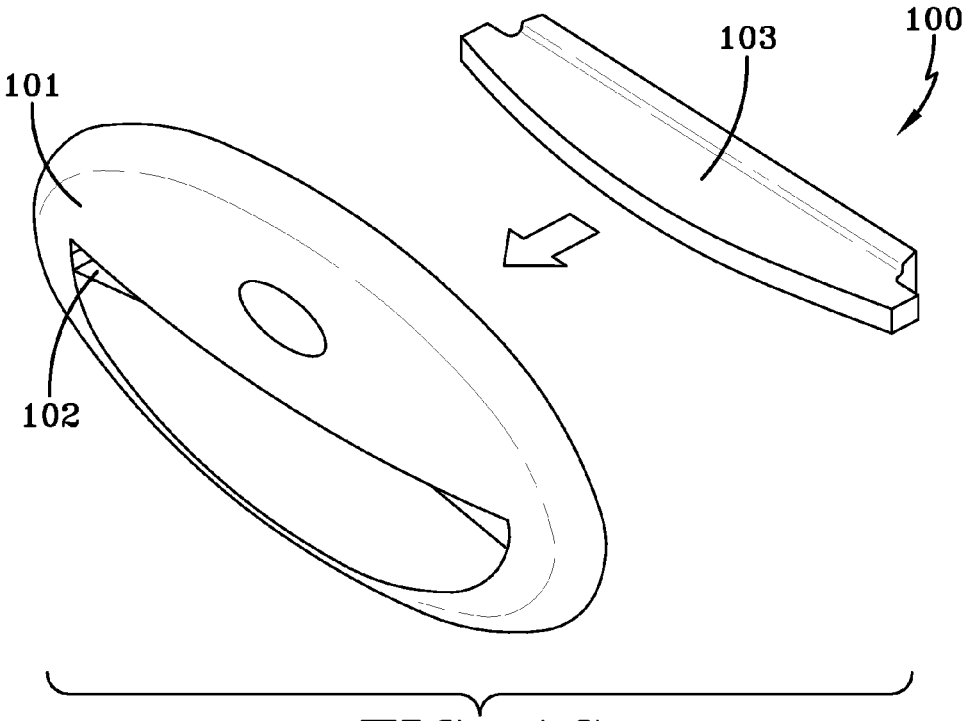
FIG. 1C is an exploded view of a front plate assembly.

FIG. 1C is an exploded view of an exemplary embodiment of a front plate or cover assembly 100. The lens 103 fits within the horizontal void 102 within the front plate or cover 101. In one embodiment, lens 103 may be any one of the following: transparent, etched, frosted, textured, or tinted. Also, an example of lens 103 may be plastic or glass.

Figure 2:
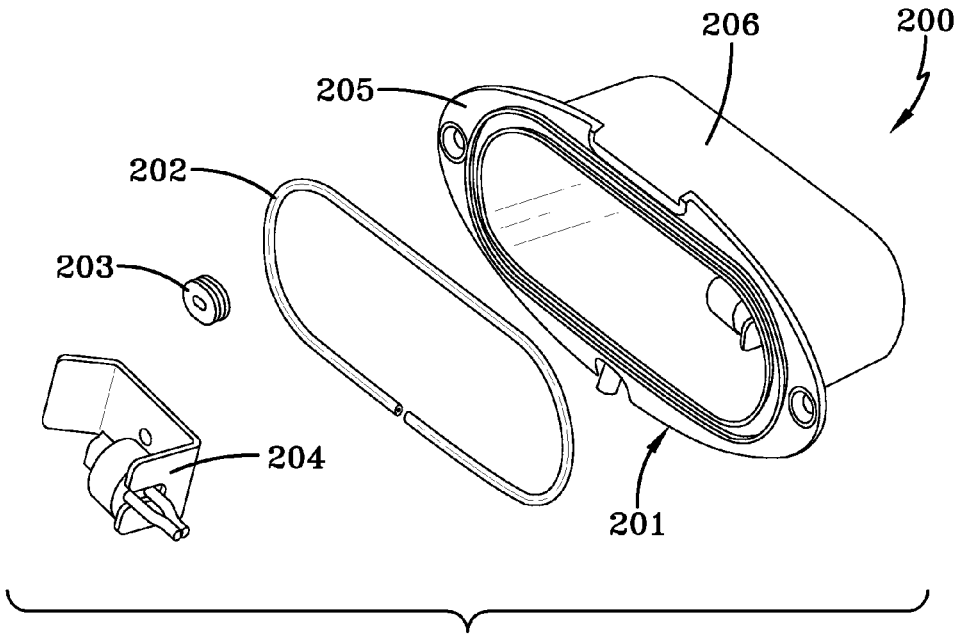
FIG. 2 is an exploded view of a rear housing assembly.

FIG. 2 is an exploded view of an example of a rear housing assembly 200. In one embodiment, the rear housing 201 may be opaque and comprised of metal or plastic. The rear housing 201 includes a flange 205 and a cavity 206. The seal 202 fits within the rear housing 201. A grommet 203 also fits within the rear housing 201 for allowing the passage of wiring. In addition, the lamp assembly 204 attaches to the rear housing 201. The seal 202 and grommet 203 may protect the lamp assembly 204 from damage, including but not limited to environmental, water, and/or insect damage.

Figure 3:
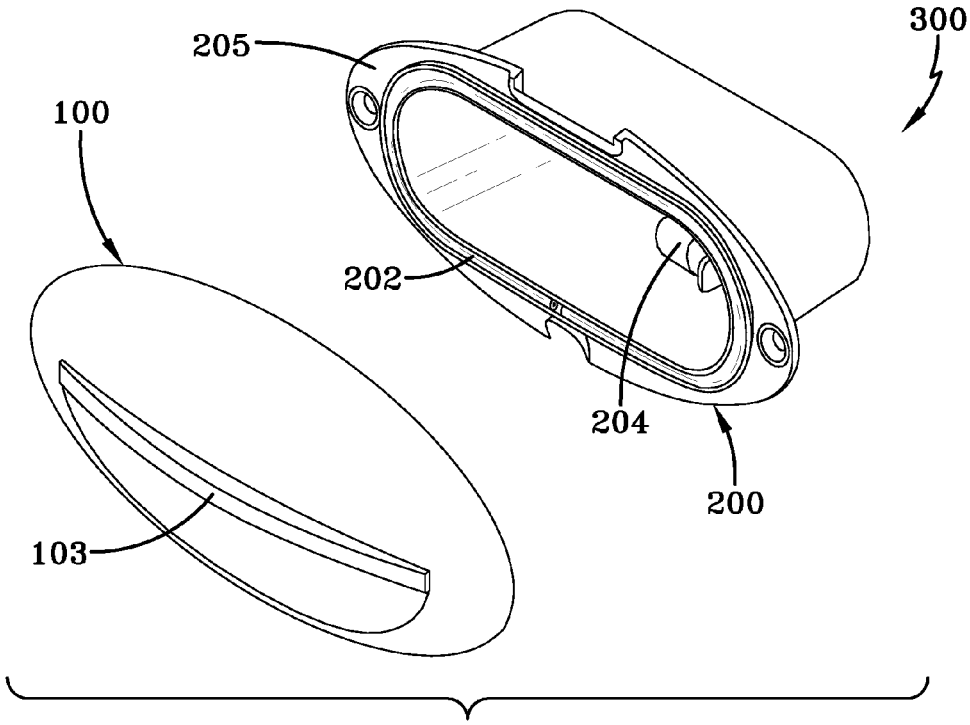
FIG. 3 is an exploded view of a stair riser light assembly.

FIG. 3 is an exploded view of an exemplary embodiment of a stair riser light assembly 300. The front plate assembly 100 attaches to the flange 205 of the rear housing assembly 200. The seal 202 may mate with the front plate assembly 100 to protect the lamp assembly 204 from damage, including but not limited to environmental, water, and insect damage. In one example, the seal 202 may be an elastomer.

Figure 4:
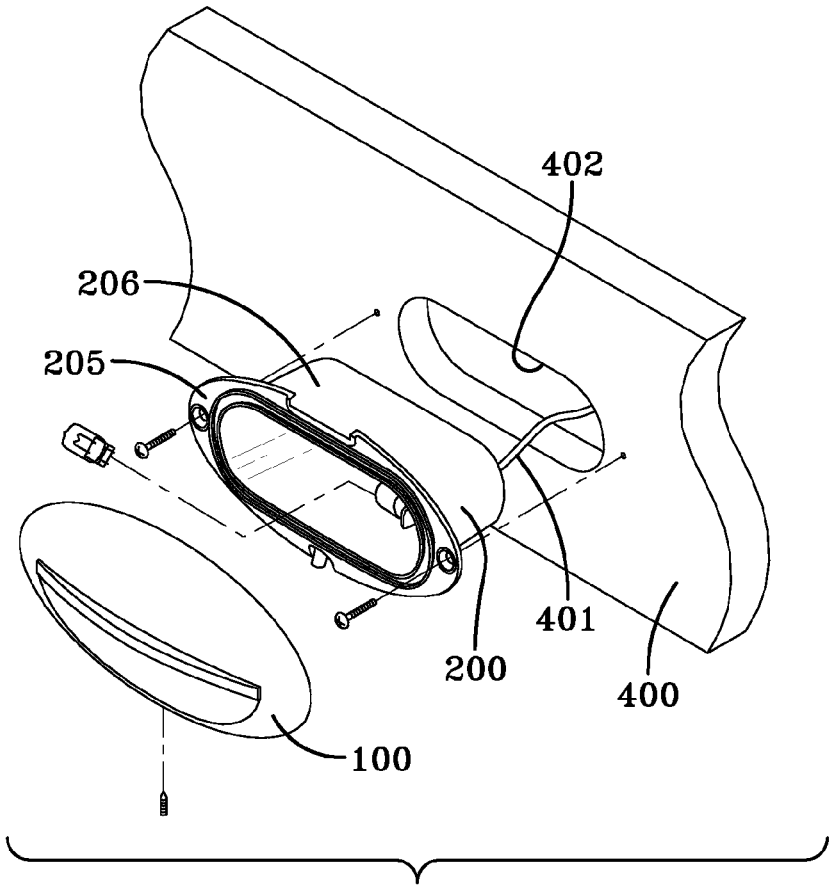
FIG. 4 is an exploded view of a front plate assembly, rear housing assembly, and a stair riser.

FIG. 4 is an exploded view of an exemplary embodiment of a front plate assembly 100, rear housing assembly 200, and a stair riser 400. The deck and stair risers may be made of well known material, such as, but not limited to, wood, plastic, wood composite, and/or metal. The cavity 206 fits within the void 402 in the stair riser 400. The flange 205 mounts against the front surface of the stair riser 400. The wiring 401 passes through a grommet in the cavity 206 to connect to the lamp assembly. The front cover assembly 100 attaches to the rear housing assembly 200 such that the front cover assembly 100 extends only minimally from the front surface of the stair riser 400. In one example, the front cover assembly 100 is adapted to extend less than one inch from the front surface of the stair riser 400. In another example, the front cover assembly 100 is adapted to extend less than one and one-half inches from the front surface of the stair riser 400. In still another example, the front cover assembly 100 is adapted to extend less than two inches from the front surface of the stair riser 400.

Figure 5A:
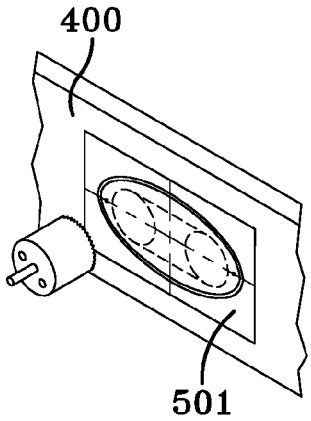
FIG. 5 is a storyboard view of the method for installing a stair riser light assembly.
Figure 5B:
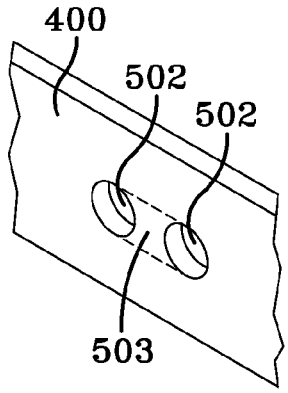
Figure 5C:
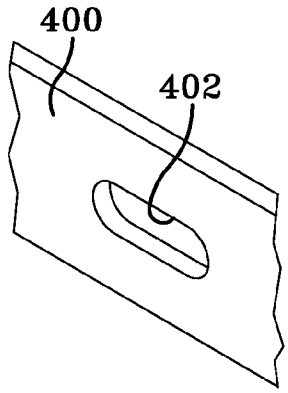

FIG. 5 is a storyboard view of the method for installing a stair riser light assembly. The method comprises three main steps: A, B, and C. In step A, a jig 501 is properly aligned on the front surface of the stair riser 400. In step B, two circular sections of material 502 are removed from the stair riser 400. In step C, the remaining material 503 between the two circular sections 502 is removed to create the void 402.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A light assembly for attachment to a stair riser that has a void and a front surface that is generally perpendicular to a horizontal surface, said light assembly comprising:

an opaque rear housing comprising a flange adapted to be attached to said front surface of said stair riser and a cavity attached to said flange and adapted to be situated within said void in said stair riser;

a lamp assembly situated in said cavity;

wiring passing through said cavity and connected to said lamp assembly; and a front cover assembly attached to said flange and comprising an opaque front cover and a lens, said lens extending through a void in said front cover defined by an upper portion of said front cover and a lower portion of said front cover, such that said lens extends beyond said upper portion of said front cover and said lower portion of said front cover;

wherein:

said rear housing and front cover assembly form a protective seal around said lamp assembly; and said front cover assembly and rear housing are adapted to direct light through said lens and toward said horizontal surface.

2. The light assembly of claim 1 further comprising:

a seal attached to said flange;

wherein said front cover assembly mates with said seal when attached to said flange.

3. The light assembly of claim 2 wherein said seal is an elastomer.

4. The light assembly of claim 1 wherein said front cover assembly is adapted to extend less than one inch from said front surface of said stair riser.

5. The light assembly of claim 1 wherein said front cover assembly is adapted to extend less than one and one-half inches from said front surface of said stair riser.

6. The light assembly of claim 1 wherein said front cover assembly is adapted to extend less than two inches from said front surface of said stair riser.

7. The light assembly of claim 1 further comprising a grommet attached to said cavity, wherein said wiring passes through said grommet.

8. The light assembly of claim 1 wherein said lens is any one of the following: transparent, etched, frosted, textured, or tinted.

9. The light assembly of claim 1 wherein said rear housing is comprised of metal or plastic.

10. The light assembly of claim 1 wherein said front cover is comprised of metal or plastic.

11. The light assembly of claim 1 wherein said lens is comprised of glass or plastic.

12. The light assembly of claim 1 further comprising said stair riser such that said flange is attached to said front surface of said stair riser and said cavity is situated within said void in said stair riser.

13. A light assembly for attachment to a stair riser that has a void and a front surface that is generally perpendicular to a horizontal surface, said light assembly comprising:

an opaque rear housing comprising a flange adapted to be attached to said front surface of said stair riser, a seal attached to said flange, and a cavity attached to said flange and adapted to be situated within said void in said stair riser;

a lamp assembly situated in said cavity;

a grommet attached to said cavity;

wiring passing through said grommet and connected to said lamp assembly; and a front cover assembly attached to said flange and comprising an opaque front cover and a lens, said lens extending through a void in said front cover defined by an upper portion of said front cover and a lower portion of said front cover, such that said lens extends beyond said upper portion of said front cover and said lower portion of said front cover; wherein:

said front cover assembly mates with said seal;

said rear housing, seal, and front cover assembly form a protective seal around said lamp assembly;

said front cover assembly and rear housing are adapted to direct light through said lens and toward said horizontal surface; and said front cover assembly is adapted to extend less than two inches from said front surface of said stair riser.

14. The light assembly of claim 13 wherein said seal is an elastomer.

15. The light assembly of claim 13 wherein said rear housing is metallic.

16. The light assembly of claim 13 further comprising said stair riser such that said flange is attached to said front surface of said stair riser and said cavity is situated within said void in said stair riser.

17. The light assembly of claim 13 wherein said lens is transparent.

18. A method for attaching the light assembly of claim 13 to a stair riser that is generally perpendicular to a horizontal surface, said stair riser comprising a front surface, said attachment method comprising:

providing a jig comprising the appropriate dimensions for forming a void for receiving said light assembly;

aligning said jig in the desired orientation on the front surface of said stair riser;

removing two circular sections of material from said stair riser by aligning a removing tool with the appropriate dimensions on said jig;

removing the material between the two circular sections to create said void;

inserting said rear housing through said void in said front surface of said stair riser;

attaching said flange to said front surface of said stair riser; and attaching said front cover to said flange.

19. The method of claim 18 further comprising routing said wiring through said void in said stair riser prior to attaching said flange to said front surface of said stair riser.

* * * * *